United States Patent [19]

Faigen et al.

[11] Patent Number: 4,598,296

[45] Date of Patent: Jul. 1, 1986

[54] DIPOLE ANTENNA SYSTEM WITH OVERHEAD COVERAGE HAVING EQUIDIRECTIONAL-LINEAR POLARIZATION

[75] Inventors: Ivan Faigen, Wayland; Michael Eovine, Woburn; David Thombs, Chelmsford, all of Mass.

[73] Assignee: Chu Associates, Inc., Littleton, Mass.

[21] Appl. No.: 636,166

[22] Filed: Jul. 31, 1984

[51] Int. Cl.[4] ..... H01Q 9/16

[52] U.S. Cl. ..... 343/730; 343/792

[58] Field of Search ..... 343/792, 725–728, 343/729, 730

[56] References Cited

U.S. PATENT DOCUMENTS

| | | | |
|---|---|---|---|
| 1,924,408 | 8/1933 | Leib | 343/728 |
| 2,426,632 | 9/1947 | Marchand | 343/726 |
| 2,657,312 | 10/1953 | Saranga | 343/727 |
| 3,438,042 | 4/1969 | Kuecken | 343/792 |
| 3,588,903 | 6/1971 | Hampton | 343/792 |

*Primary Examiner*—Eli Lieberman

*Attorney, Agent, or Firm*—Rines and Rines Shapiro and Shapiro

[57] ABSTRACT

A vertically oriented dipole antenna system for filling in overhead radiation or reception coverage with equidirectional-linear polarization (a linearly polarized field vector which lies in the plane of the system's vertical and horizontal axes) having, in combination, a balanced vertically oriented cylindrical dipole the inner adjacent ends of the elements of which are connected to supplemental conductors at points near the inner end of one element substantially ninety degrees apart along the circumference of the element and each extending outward a distance of the order of 0.15 of the wavelength of the mean frequency with which the antenna is to be operated and at an acute angle of the order of 33° with respect to the horizontal, and a second pair of similar supplemental conductors connected to points near the inner end of the other element substantially ninety degrees circumferentially apart from one another and from the first-named points and of length substantially the said distance and extending at substantially said acute angle.

8 Claims, 3 Drawing Figures

DIPOLE ANTENNA SYSTEM WITH OVERHEAD COVERAGE HAVING EQUIDIRECTIONAL-LINEAR POLARIZATION

The present invention relates to radio-frequency-energy transmission line systems and, more particularly, to systems and antenna structures adapted for use as aeronautical communications, radio navigation and similar antennas.

In many UHF and VHF antenna transmitting systems, an omnidriectional horizontal radiation pattern such as that of a dipole along with a desired vertical radiation pattern are required to provide uniform broadcasting in all directions of azimuth and over a desired field of coverage. Many antennas have been designed for producing such patterns. The antennas are physically convenient and mechanically simple, and are one of the reasons for the wide spread use of these frequencies.

The term "omnidirectional" is used in practice to indicate uniform or near-uniform coverage in the horizontal plane. In the simplest form, this requirement is met by a small loop or a vertical dipole, but vertical arrays of such elements may be employed to provide additional gain or to modify the radiation pattern in the elevation plane while maintaining omnidirectional coverage in the horizontal plane.

Typical antennas that are designed for broadband UHF/VHF services, such as ground-to-air (air traffic control) applications, are colinear, discone, coaxial stub, and dipole antennas.

All of these antennas provide omnidirectional horizontal radiation patterns. But they also have an inherent null in the vertical radiation pattern. This null causes an undesirable "blackout" in direct overhead communications.

In present practice it is desired to provide an omnidirectional horizontal radiation pattern along with a vertical radiation pattern that has an overhead fill. Some antennas which have been designed to achieve this, are the Bent Dipole, Stripped Can, Spiral Overhead and an antenna that actually consists of two separate antennas, one of which radiates in the normal mode and the other in the axial mode. These antennas either have only unilinear, bi-linear, multi-linear, or circular polarization fill capability and in some cases provide a poor omnidirectional horizontal radiation pattern. These designs still alllow for a blackout condition to occur and/or have a poor response in the horizontal plane.

An object of the present invention, accordingly, is to provide a new and improved antenna that is particularly for use at high power and that produces an omnidirectional vertically polarized horizontal radiation pattern along with a vertical radiation pattern having equidirectional-linear polarization over a broadband that has an inherent "overhead null fill"; the antenna being free of the above-described disadvantages.

In the vertical plane, this antenna responds to or transmits equidirectional-linear polarization. The definition of equidirectional-linear polarization being a linear polarized field vector which lies in the plane of the antenna's vertical and horizontal axes. This inherent characteristic is a direct result of the addition of radial elements to the dipole antenna, which allows for full hemispherical coverage eliminating any blackout from occuring in this region.

An additional object is to provide an antenna that is particularly adapted for operation as an aeronautical communications or radio navigational antenna.

Still an additional object is to provide such an antenna that is completely enclosed and thus not subject to the elements, and that is of rugged and simple construction comprising a radiating preferably cylindrical mass structure that houses a simple transmission line system adapted to produce the desired performance.

Still an additional object is to provide such an antenna that is inexpensive to manufacture and maintain.

Other and further objects are explained hereinafter and are more particularly delineated in the appended claims.

In summary, however, from one of its important aspects the invention embraces a vertically oriented dipole antennna apparatus for filling in overhead radiation or reception coverage with equidirectional-linear polarization having, in combination, a balanced vertically oriented cylindrical dipole the inner adjacent ends of the elements of which are connected to supplemental conductors near the inner end of one element substantially ninety degrees apart along the circumference of the element and each extending radially outward a distance of the order of 0.15 of the wavelength of the mean frequency with which the antenna is to be operated and at an acute angle of the order of 33° with respect to the horizontal, and a second pair of similar supplemental conductors connected to points near the inner end of the other element substantially ninety degrees circumferentially apart from one another and from the first-named supplemental conductors substantially the said distance and extending at substantially said acute angle. Preferred details and other features are hereinafter presented.

The invention will now be described in connection with the accompanying drawings:

FIG. 1 of which is an elevated partially cut-away side view of an antenna of the present invention;

Figure 1:
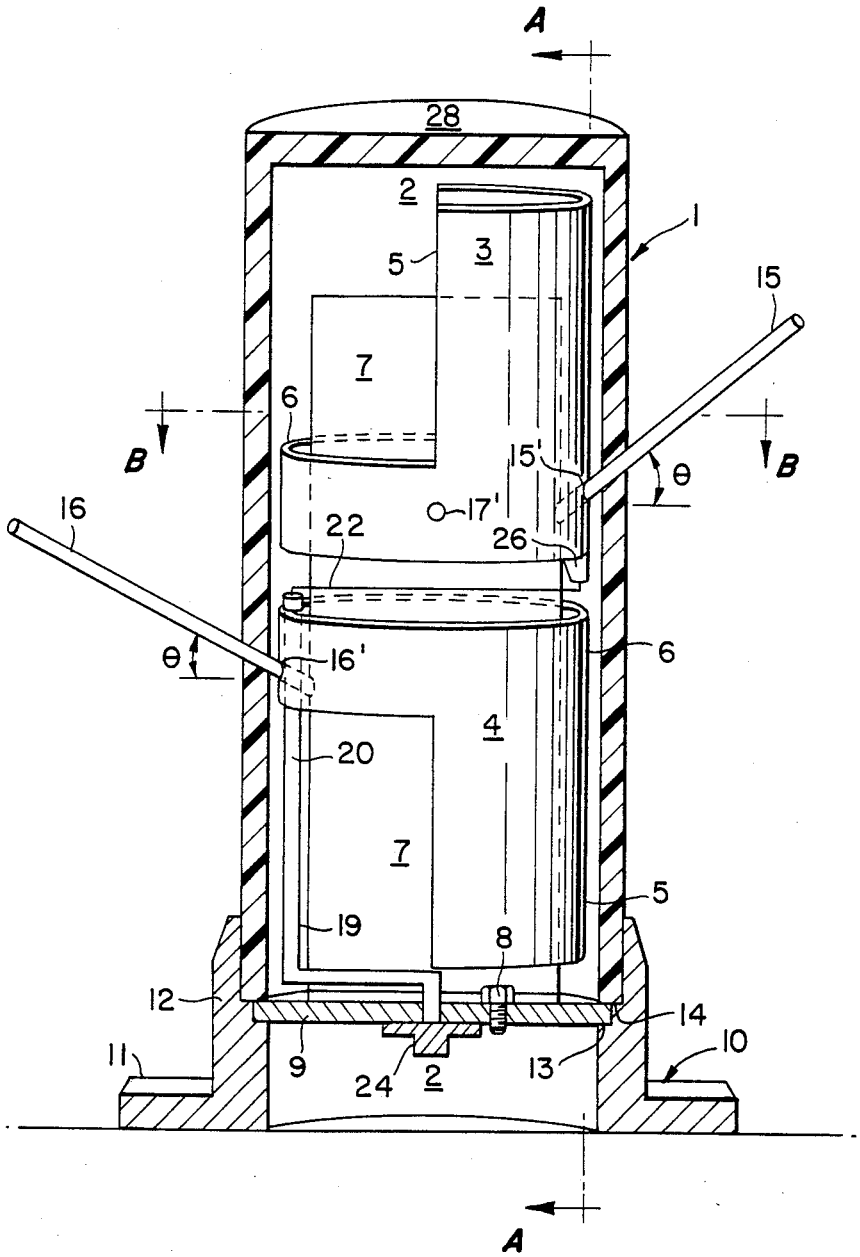
Figure 2:
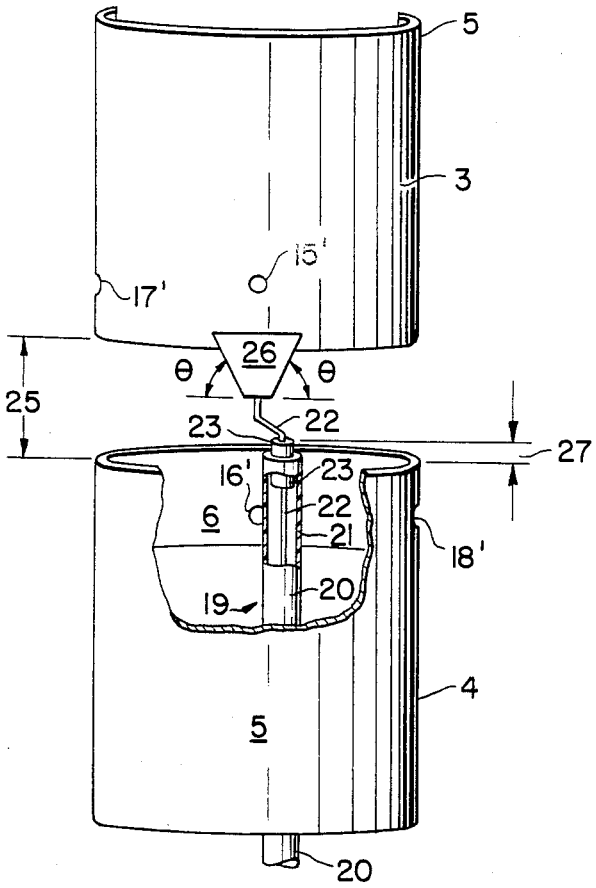
FIG. 2 is a detailed partially cut-away side view, without the housing or support bracket, of the unbalanced coaxial transmission line electrical connection between the dipole elements of the antenna taken along the line A—A of FIG. 1.

As before stated, FIG. 1 illustrates an antenna system of the present invention, being particularly suited to a high power, moderate gain, broadband antenna of the present invention with housing and base features cut away to show detail. The antenna has an insulating cylindrical housing 1, shown cut away in FIG. 1 along the line C—C of FIG. 3, such as a fiberglass cylinder, having an internal cavity 2 extending substantially throughout the housing 1. Disposed within the housing 1 are two balanced cylindrical dipole elements 3 and 4 which may be fully cylindrical elements or composed of a half (or other partial) cylindrical section 5 in conjunction with a full cylindrical section 6, as shown in FIGS. 1 and 2, both full cylindrical and composite dipoles being defined as cylindrical. The cylindrical dipole elements 3 and 4 are secured within the cavity of housing 1 by riveting to a non-conductive bracket, such as fiberglass L-bracket 7, such that the cylindrical sections 6 of the dipole elements 3 and 4 are secured in close proximity and coaxially aligned with the respective half cylindrical members 5 aligned to extend vertically oppositely of each other with one member 5 exactly above the other member 5, such that the elements 3 and 4 are colinearly aligned.

The Fiberglass L-bracket 7 is rigidly secured within the housing 1 by a bolt 8 with a head adapted with a slot of slightly greater width than the thickness of the L-bracket 7. The L-bracket 7 being inserted into the head-slot of the bolt 8 and frictionally engaged thereby. the bolt 8 is secured to a conductive metal plate, such as aluminum base plate 9 which is concentrically secured to the housing 1 by concentric bonding to a mounting base 10 as described hereinafter. The base plate 9 and mounting base 10 are shown in FIG. 1 as cut away along the line C—C of FIG. 3 to show internal detail.

Figure 3:
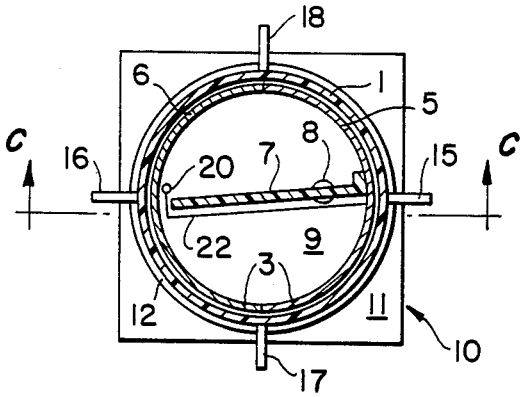
FIG. 3 is a cut-away top view of the antenna, taken along the line B—B of FIG. 1, showing the positions of the radial antenna elements.

The mounting base 10 is a unitary construction, structurally rigid structure with a square foot section 11 and a circular sleeve section 12 as seen in FIGS. 1 and 3. The outer diameter of the sleeve section 12 is greater than the diameter of the base plate 9 and the cylindrical housing 1 and the foot section 11 have sufficient surface area to provide a stable base for the antenna structure. The foot section 11 may also be adapted with holes (not shown) to receive bolts or rivets to secure the antenna structure to a surface during use.

The sleeve section 12 has a first concentric recess 13 of a diameter slightly larger than the diameter of the base plate 9 and adapted to receive and support the base plate 9. The sleeve section 12 also has a second concentric recess 14 of a diameter slightly larger than the diameter of the housing 1 and adapted to receive a portion of the housing 1 inserted into the second recess 14 of the sleeve section 12 of the mounting base 10. The base plate 9 and housing 1 may be bonded to the recesses 13 and 14 by an acceptable means to rigidly secure the entire structure.

The antenna system is also provided with a plurality of supplemental conductors, such as conductors 15, 16, 17 and 18 which are preferably cylindrical brass rods and are securely and electrically conductively connected to the cylindrical dipole elements 3 and 4 as by soldering or screwing a threaded end of each supplemental conductor 15, 16, 17 or 18 into a matched receiving hole 15', 16', 17', and 18' in the dipole elements 3 and 4, respectively as seen in FIGS. 1–3. In such an arrangement supplemental conductors 15 and 17 are secured ninety degrees apart along the circumference of element 3 and supplemental conductors 16 and 18 are secured 90 degrees apart along the circumference of element 4 with conductors 16 and 18 secured 90 degrees apart from conductors 17 and 15 respectively, as seen in FIG. 3. The supplemental conductors 15, 16, 17 and 18 are therefore rigidly and electrically mounted to the cylindrical dipole elements 3 and 4, and extend through holes or slots in the housing 1. The supplemental conductors 15–18 also radially extend from the elements 3 and 4, as previously described, around the periphery of the antenna such that each supplemental conductor 15–18 is spaced substantially ninety degrees apart along the circumference of the cylindrical dipole elements 3 and 4 and the antenna system.

The supplemental conductors 15–18 are also secured such that the length extending radially outward from the respective elements 3 and 4 is approximately 0.15 of the wave length of the mean frequency with which the antenna is to be operated. The supplemental conductors 15–18 also extend at an upward acute angle 0 which is of the order of 33° with respect to the horizontal. With the cylindrical dipole elements 3 and 4 capable of providing radiation in all directions of azimuth and the four cylindrical, radially extending supplemental conductors 15–18 capable of providing the desired degree of vertical radiation, an antenna system is provided that satisfies the objects previously stated.

A transmission line system 19 for propagating the radio-frequency-energy that may either be fed from a transmitter to the antenna elements 3 and 4 to enable them, and the supplemental conductors 15–18, to radiate into space, or may be fed from the cylindrical dipole antenna elements 3 and 4 to a receiver, extends within and along the illustrated vertical direction of one of the partial half and whole cylindrical antenna element 4 and is connected to the other similar element 3 as shown in FIGS. 1 and 3 and in detail in FIG. 2. The transmission line system 19 comprises, at its lower end, an unbalanced co-axial transmission line 20 having an outer conductor 21 and a co-axially disposed inner conductor 22, insulated therefrom by an insulator 23. The insulator 23 may be a solid dielectric material, such as rubber or Teflon, or it may be air or other gas maintained at any desired pressure. The co-axial line 20 is provided at its lower end with a connector 24 for connection to a transmitter or receiver, not shown. The connector 24 may be secured to the base plate 9 to provide an antenna feed-point external to the antenna housing 1, as shown in FIG. 1. The co-axial line 20 of the transmission line system 19 is connected to the cylindrical dipole elements 3 and 4 by securing the outer conductor 21 in electrical contact, as by soldering, to the cylindrical section 6 of the lower dipole element 4 and securing the inner conductor 22 in electrical contact to the cylindrical section 6 of the upper cylindrical dipole element 3 as shown in FIGS. 1 and 2.

In accordance with the present invention, the transition from the unbalanced co-axial line 20 to the balanced radiating structure, composed of the cylindrical dipole elements 3 and 4 in conjunction with the supplemental conductors 15–18, is effected by extending the inner conductor 22 upward across a gap 25 between the cylindrical dipole elements 3 and 4, as seen in FIGS. 1 and 2. The inner conductor 22 is tapered (flared out) at an angle 0, which is approximately 45° to the horizontal at each side of inner conductor end 26, which is mechanically and electrically connected to the cylindrical dipole element 3, as by soldering, as previously described. The insulator 23 is also extended upward of the top edge of the cylindrical dipole element 4 to a predetermined position along the inner conductor 22, such as extended distance 27, although the outer conductor 21 is terminated at the top of the cylindrical dipole element 4, as shown in FIG. 2. Extending the insulator 23 the extended distance 27 past the end of the cylindrical dipole element 4 shields the inner conductor 22 from electrical contact with either the outer conductor 21 or the cylindrical dipole element 4. Additionally, the extended insulator 23 in conjunction with the tapered inner conductor 26 provides proper connection between the unbalanced line system 19 and the balanced radiating system constructed of the dipole elements 3 and 4 and the supplemental conductors 15–18, without the normally needed prior-art compensating stub coils or other devices previously mentioned.

The antenna structure is therefore simplified over prior antennas of similar construction through the use of minimal connections for effecting balanced-to-unbalanced line feed, and the actual length of over-all transmission line is kept to a minimum. This antenna structure, moreover, so long as the gap 25 is of small dimension, such as $\frac{1}{8}$ wavelength or less, will effect the balanced-to-unbalanced transition over relatively wide frequency ranges (225–400 MHz), by reducing the shunt capacitance of the gap 25 and therefore presents substantially the same impedance over the gap 25.

While the antenna structure disclosed will produce excellent horizontal omnidirectionality, it is also capable of radiating directly upward, for an "overhead fill". This additional feature is a direct result of the radially dispersed supplemental conductors 15–18 which are energized directly by the respective upper and lower full cylindrical sections 6 of the dipole elements 3 and 4, as previously discussed.

As shown in FIG. 1, the fiberglass or other housing 1 of the antenna may be capped or sealed at the upper end, as shown at 28, and sealed at the lower end by the base plate 9 and the mounting base 10 as shown at 13 to provide a sealed, extremely light weight and rugged antenna unit. The supplemental conductors 15–18 may be of screw in, fold down or other similar nature for ease in handling. The unit may be approximately thirty-two inches in length and nominally three inches in diameter, exclusive of its mounting base 10, with supplemental conductors 15–18 of 10–10½ inches in length, in which event it is found to weigh less than 8.5 lbs. All of the metallic parts may be maintained at direct current ground potential by grounding the same, as by a grounding conductor electrically connected to the base plate 9 (not shown), to afford lightning protection. The enclosed type of design, moreover, precludes much of the trouble ordinarily encountered due to rough or poor handling or adjustment in field operations, particularly where the antenna may be utilized for portable operations. Additionally, the design affords maximum weather protection, and is extremely easy for field assembly and installation by untrained crews.

Further modifications will occur to those skilled in the art and all such are considered to fall within the spirit and scope of the invention, as defined in the appended claims.

What is claimed is:

1. Antenna apparatus comprising a vertically oriented cylindrical dipole antenna including a pair of antenna elements that are spaced apart vertically at adjacent ends, and a plurality of supplemental conductors connected to said dipole antenna at points near said adjacent ends of said elements and successively spaced substantially 90 degrees apart circumferentially of the dipole antenna, one pair of said supplemental conductors being connected to one of said elements and another pair of said supplemental conductors being connected to the other of said elements, each of said supplemental conductors extending outwardly from said dipole antenna and upwardly at an acute angle with respect to horizontal.

2. Antenna apparatus in accordance with claim 1, wherein the supplemental conductors of said one pair are rods spaced apart substantially 90 degrees circumferentially of one of said elements and wherein the supplemental conductors of said other pair are rods spaced apart substantially 90 degrees circumferentially of the other of said elements.

3. Antenna apparatus in accordance with claim 1, wherein the outward length of each of said supplemental conductors is of the order of 0.15 wavelength of the mean operating frequency of the antenna apparatus and wherein said acute angle is of the order of 33 degrees.

4. Antenna apparatus in accordance with claim 1, wherein said apparatus includes a transmission line connected to said dipole antenna near said adjacent ends of said elements.

5. Antenna apparatus in accordance with claim 1, wherein said dipole antenna is a balanced radiating structure and has an unbalanced transmission line with transmission line conductors connected to the adjacent ends of said elements, respectively.

6. Antenna apparatus in accordance with claim 5, wherein said transmission line is a coaxial transmission line having its outer conductor connected to one of said elements at one side thereof adjacent to one of said supplemental conductors and having its inner conductor connected to the other of said elements at another side thereof adjacent to another of said supplemental conductors.

7. Antenna apparatus in accordance with claim 6, wherein the connection of said inner conductor to said other element is by means of a tapered plate having a narrow end connected to said inner conductor and a wide end connected to said other element.

8. Antenna apparatus in accordance with claim 7, wherein said adjacent ends of said elements are spaced apart by a distance that is less than about 150 of the mean operating wavelength of the antenna apparatus.

* * * * *